US006408153B1

(12) United States Patent
Vandewinckel et al.

(10) Patent No.: US 6,408,153 B1
(45) Date of Patent: Jun. 18, 2002

(54) METHOD AND APPARATUS FOR ULTRASONIC SCREEN CLEANING IN A PARTICULATE DELIVERY SYSTEM

(75) Inventors: Judith M. Vandewinckel, Livonia; Robert F. Bulger, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/725,799

(22) Filed: Nov. 30, 2000

(51) Int. Cl.[7] ..... G03G 15/08
(52) U.S. Cl. ..... 399/253
(58) Field of Search ..... 399/98, 253, 258, 399/261, 272, 281, 358, 359; 209/379, 381, 715, 721; 222/DIG. 1

(56) References Cited

U.S. PATENT DOCUMENTS 5,019,870 A * 5/1991 Bares ..... 399/272 X
5,455,666 A * 10/1995 Saito et al. ..... 399/359
5,512,994 A * 4/1996 Koike ..... 399/358
5,521,690 A * 5/1996 Taffler et al. ..... 222/DIG. 1 X
5,532,800 A * 7/1996 Saito ..... 399/253
5,600,411 A * 2/1997 Hart ..... 399/98
5,628,406 A * 5/1997 Yoshida et al. ..... 399/358 X
5,768,666 A * 6/1998 Ito et al. ..... 399/261 X
5,799,799 A * 9/1998 Alamzad et al. ..... 209/379 X
5,915,566 A * 6/1999 Senapati ..... 209/365.1

FOREIGN PATENT DOCUMENTS

JP 03-202877 * 9/1991

* cited by examiner

*Primary Examiner*—Sandra Brase
(74) *Attorney, Agent, or Firm*—Oliff & Berridge, PLC; Eugene Palazzo

(57) ABSTRACT

An improvement for use in a fine particle delivery system that separates particulate material according to particle size, such as a toner screener used in an electrophotographic imaging machine. The fine particle delivery system includes an intake duct that receives particulate material, a screen that filters the materials as the particles move or rotate about the screen, and a pair of opposed ultrasonic transducer assemblies that excite the screen to dislodge particulate material adhering to the screen mesh. Each transducer assembly includes a transducer, a rigid metallic membrane coupled to transducer to efficiently deliver ultrasonic waves to the screen, and a mounting mechanism that supports the transducer assembly. A channel embedded with the mounting mechanism protects electrical wiring the powers the transducer from a potentially explosive environment of particulate material during screening operations. The mounting mechanism also provides convenient retrofitting of the transducer assembly with existing particulate screening systems or a pivotal mounting connection with a frame of the particulate delivery system to provide a screen removal clearance for servicing.

26 Claims, 6 Drawing Sheets

METHOD AND APPARATUS FOR ULTRASONIC SCREEN CLEANING IN A PARTICULATE DELIVERY SYSTEM

BACKGROUND OF THE INVENTION

The present invention relates to particulate material delivery and screening, but more particularly to a method and an apparatus that cleans and prevents adhesion of fine particles or powders to a mesh during screening operations.

Electrophotographic imaging systems, for example, use color toners and emulsion aggregates in the form of fine particles that represent various colors in the imaging process. To improve image quality, such toner particles require screening to limit the range of particle size for the various imaging stages in the imaging system. Conventional screening is performed by a mesh size in the order of 37 to 74 $\mu$m, although standard screen gradations generally vary from about 20 $\mu$m or smaller to about 1000 $\mu$m. In many advanced electrophotographic machines, however, toner particle size requirements have lessened in size down to a mean diameter of about 5.0 to 8.5 $\mu$m, which is obtained by screening through a finer mesh, such as a 20 $\mu$m screen mesh. Finer toner particles are difficult to screen through these smaller meshes, particularly if they include chemical additives to improve charging, flow, lubrication, and/or fusing at the various possessing stages of an electrophotographic machine. Such additives have a tendency to adhere to or blind the wire mesh used to screen the particles. Various toner formulations may include as much as 3 to 10% by weight of such additives.

Smaller screen sizes and greater amounts of additives increase screen blinding and impair cleaning. This also retards screening operations thereby lowering the overall efficiency and throughput of the machine, and also causes material waste since good fines may be discarded with coarse material during impaired screening operations. The addition of chemical additives causes toner buildup and particle fusing on the screen mesh, which undesirably impacts the overall life of the screen and downtime of the machine. The life of a turbo screen in Xerox models 5760 and 5790, for example, is about 5000 pounds of toner whereupon the screen must be removed, cleaned, and/or replaced. Some screens have a life of about 10,000 to 12,000 pounds of toner before they require removal and/or solvent cleaning. Imaging is one example in which fine particulate material screening is performed, it being understood that screen life, machine down time, and service cycles varying according to the industrial application at hand.

During turbo screening, for example, fine and coarse particles are separated in a cyclone chamber by weight or particle size where the coarse particles are collected at a periphery of the chamber and discarded. Blinding of the turbo screen during operation causes some of the fine particles to be discarded with the coarse material, thereby increasing the overall yield loss of the fine particles during the screening process. On the other hand, lessening the chance of screen blinding improves overall yield. In an electrophotographic imaging application using resinous toners, this save substantial amounts of color and black fines.

U.S. Pat. No. 5,016,055 assigned to the assignee hereof discloses vibratory energy applied to a charge retentive surface in order to enhance imaging in an electrophotographic imaging process. Numerous other vibratory and ultrasonic systems are described therein, all of which are incorporated herein by reference. Ultrasonic cleaning has also previously been used in electrophotographic imaging machines, such as disclosed in U.S. Pat. No. 5,915,566 by Senapati and assigned to Sweco Incorporated. The Sweco patent describes an ultrasonic ring disposed about the periphery of a screen to improve particle screening in a horizontal gravity fed screener. That system has been shown to clear screen blinding caused by toner particles having a high content of fines, e.g., 60–70% by number of particle sizes between 0.126 $\mu$m and 4 $\mu$m, in color toners of low melting polyester.

The present invention addresses particle screening and de-blinding in a turbo screening operation that may, for example, be used in an electrophotographic imaging machine. The present invention also addresses design issues that arise in retrofitting existing screeners with improved de-blinding and cleaning systems and methods. The present invention further addresses energy consumption and efficiency issues that arise when attempting to provide ultrasonic screening, generally.

SUMMARY OF THE INVENTION

In accordance with the invention, there is provided a particulate delivery system that includes ultrasonic cleaning for a screen where the system comprises a housing, a chamber (e.g., a cyclone chamber) within the housing that separates particles by moving or circulating the particles within the chamber, a screen located within the chamber that passes particles less than a predetermined size, and at least one transducer coupled to the housing that delivers ultrasonic energy to the screen during screening operations whereby to dislodge particles adhering to the screen.

In accordance with another aspect of the invention, de-blinding and screen cleaning is provided for a turbo screener used in an electrophotographic imaging machine. Such an improvement comprises first and second transducer assemblies that each comprise a transducer, a rigid membrane that is ultrasonically driven by the transducer, and a mounting mechanism that supports the transducer assembly on a frame of the turbo screener so as to acoustically couple each membrane and the screen.

In accordance with yet another aspect of the invention, a method of delivering particulate material in a particulate material delivery system comprises circulating or agitating the particle material within a chamber to separate the particulate material by at least one of size and weight, screening the particulate material during within the chamber using a mesh that passes particles of a predetermined size, and inducing ultrasonic waves within the chamber and applying the waves to the mesh during screening whereby to dislodge particles adhering to the mesh.

Advantages provided by the invention include longer screen or mesh service and/or replacement cycles, less downtime, lower yield loss of fines, and the prevention of screen blinding during screening. In addition, the design and construction of the ultrasonic device provided herein conveniently enables retrofitting existing screening devices.

Other features, advantages, and aspects of the invention will become apparent upon review of the succeeding description taken in connection with the accompanying drawings. The invention, though, is pointed out with particularity by the appended claims.

DESCRIPTION OF ILLUSTRATIVE EMBODIMENTS

Figure 1A:
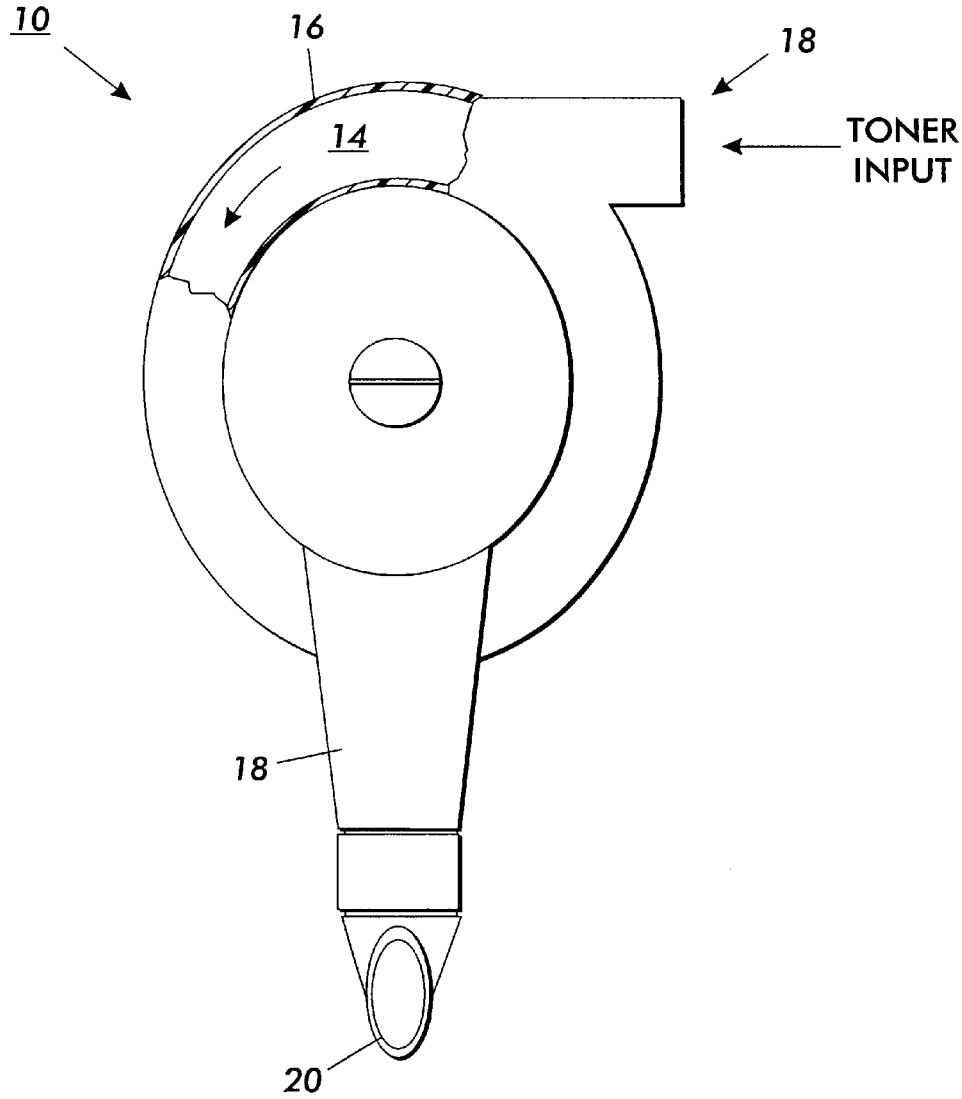
FIGS. 1A and 1B respectively show front and side views of a turbo screener in which an embodiment of the present invention may be deployed.
Figure 1B:
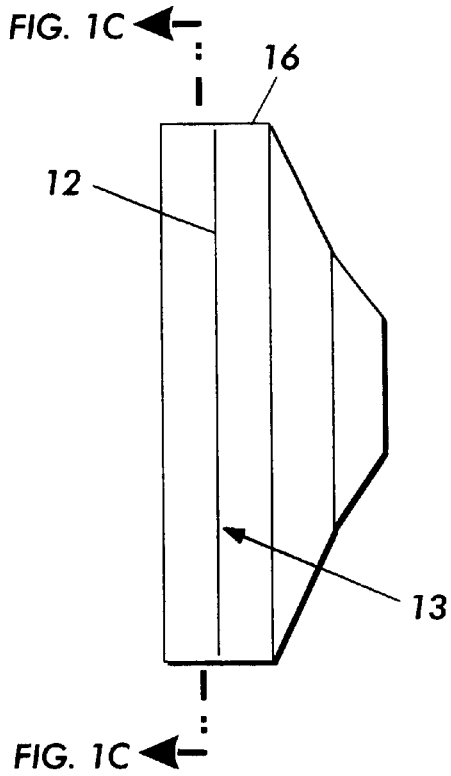
Figure 1C:
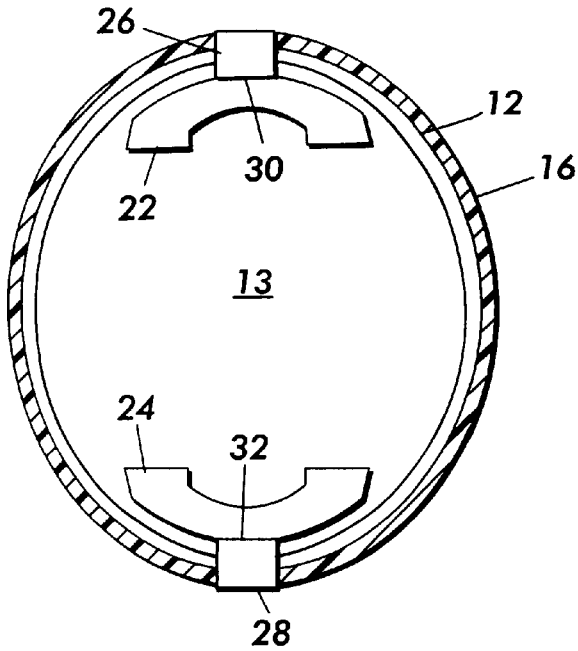
FIG. 1C is a cross-section along lines B—B of FIG. 1B, depicting the internal chamber of the turbo screener to illustrate deployment of a transducer cleaning system in accordance with one aspect of the present invention.

FIGS. 1A and 1B respectively show front and side views of a turbo screening device 10 disposed in an upright position. In accordance with a feature of the present invention, FIG. 1C depicts a cross-cut along lines B—B of FIG. 1B and shows an ultrasonic mechanism that cleans and prevents blinding of screen 12. Screen 12 is also vertically disposed inside chamber 14. In one embodiment, screen 12 may have a diameter of about eighteen inches and a wire pitch in the mesh of screen of thirty-seven $\mu$m. The turbo screening device 10 comprises a housing 16 in which toner particles enter at intake duct 18 located at an upper portion of housing 16 and swirl counter-clockwise in cyclone chamber 14. Toner particles enter duct 18 under pressure and move in a spiraling fashion towards the front of screen 12 and through a front side 13 of screen 12. Coarse particles in the fluidic toner mixture that are too large to pass through screen 12 are centrifuged to the outer perimeter of cyclone chamber 14 where they are funneled to chute 18 and collected at trap 20 located at a lower portion of the turbo screening device 10.

In one preferred embodiment of the invention, a pair of substantially vertically aligned membranes 22 and 24 affixed internally at upper and lower portions of housing 16 impart acoustic energy to the back side of screen 12. Dual membranes 22 and 24 improve the efficiency of cleaning and particle removal in the vertical screen 12, but a single or multiple membranes may also be employed. Preferably, each membrane comprises a solid metal disc having a half-moon shape and comprised of a material suitable for receiving and conveying ultrasonic energy from a respective transducer 26 or 28 attached thereto. Membrane discs 22 and 24 impart acoustic energy to the surface of screen 12 by reflection or direct contact therewith.

In the illustrated arrangement, ultrasonic transducers 26 and 28 may be welded or bolted to the centers 30 and 32 of membrane discs 22 and 24. Due to the resulting contact, electromechanical or magnetorestrictive forces generated by transducers 26 and 28 transfer acoustic waves to membranes 22 and 24 through the respective contact points 30 and 32. This, in turn, radiates two-dimensional ultrasonic waves outwardly from the points of contact of the membranes thereby to transfer acoustic energy to screen 12. Transducers 26 and 28 may be continuously or impulse excited. In one embodiment, piezoelectric or magnetorestrictive transducers 26 and 28 were excited at a frequency of thirty-six kilohertz (which is beyond the audible range of humans), an amplitude of 4.0 to 6 $\mu$m, and a duty cycle within a range of near zero to 100%, e.g., continuously on. Under these conditions, membranes 22 and 24 de-blinded particles loosely adhered between the wire meshes of screen 12.

Ultrasonic energy was transferred to the screen by direct contact between the membrane and the surface of screen 12. It has also been found that relatively low energies are sufficient to effect adequate cleaning operations, thus the invention has a relatively low impact on any power supply used in the screening operation.

Figure 2A:
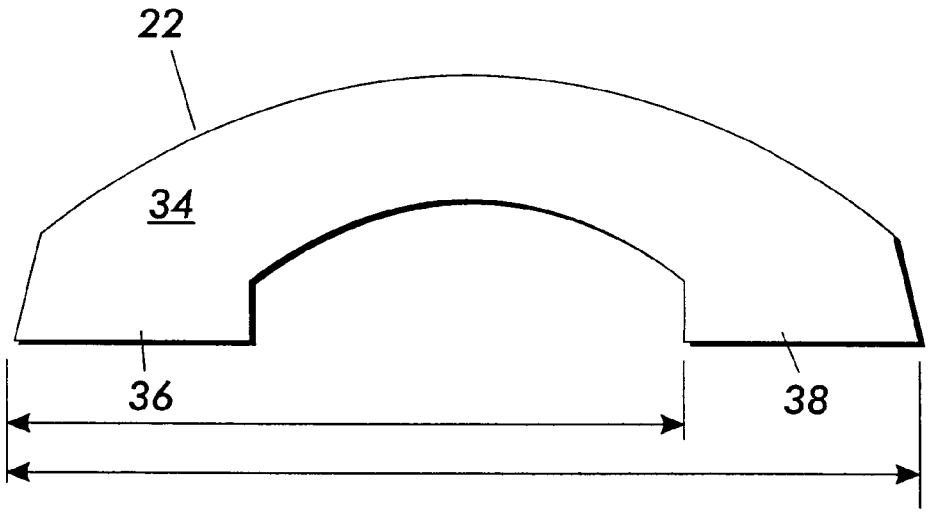
FIGS. 2A and 2B show top and perspective views of a membrane of FIG. 1C that may be used to couple ultrasonic waves to a screen or mesh in accordance with one aspect of the present invention.
Figure 2B:
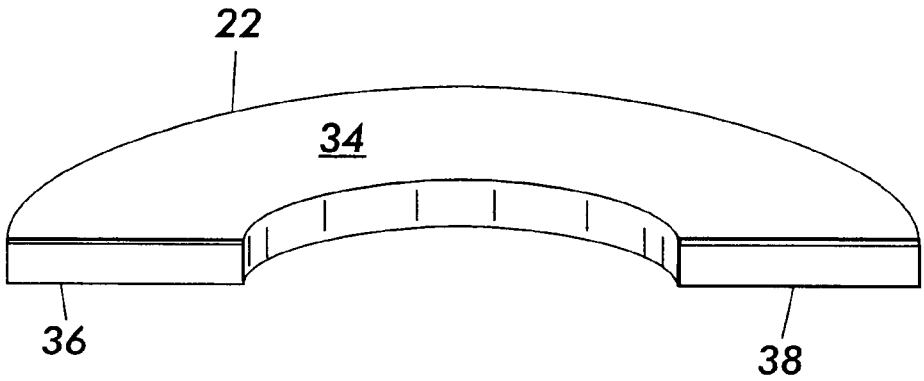

FIGS. 2A and 2B depict a half-moon construction of an illustrative ultrasonic membrane that imparts acoustic energy to screen 12 (FIGS. 1B and 1C). As shown, the membrane is semi-circular in shape and comprises any material suitable for conveying acoustic energy. Preferably, membranes 22 and 24 have a natural harmonic frequency of resonance such that when excited by transducers at a base frequency or harmonic thereof, the membranes oscillate at maximum excursions to impart by reflection or otherwise the greatest ultrasonic energy to screen 12. Such excitation maximizes the efficiency in the transfer of energy between the membranes and the screen, i.e., to attain the greatest efficiency in de-blinding and cleaning for a given amount of power applied to the transducer. This also minimizes the amount of power needed to drive the transducers.

Membranes 22 and 24 may take on other geometric shapes, as well. Generally, each membrane 22 and 24 comprises a rigid symmetric piece of metal having a predetermined resonant frequency, e.g., thirty-six kilohertz. Similar to a tuning fork, the size, shape, material, modulus of elasticity, material constituency, geometry of the membranes, as well as other characteristics known in the art, dictate the natural harmonic frequency. Suitable membrane materials that possess a high modulus of elasticity include molybdenum, certain high carbon steels, or other materials.

When energized by a voltage source, the transducer 26 bolted or welded to the center of a top surface 34 of the membrane 22 radiates ultrasonic waves from the center of the membrane towards respective ends 36 and 38 thereby to set up mechanical oscillations in the membrane 22. These oscillations, in turn, generate pulsating ultrasonic waves that are imparted to screen 12 through direct contact with the screen 12. A similar construction is provided for membrane 34.

Figure 3A:
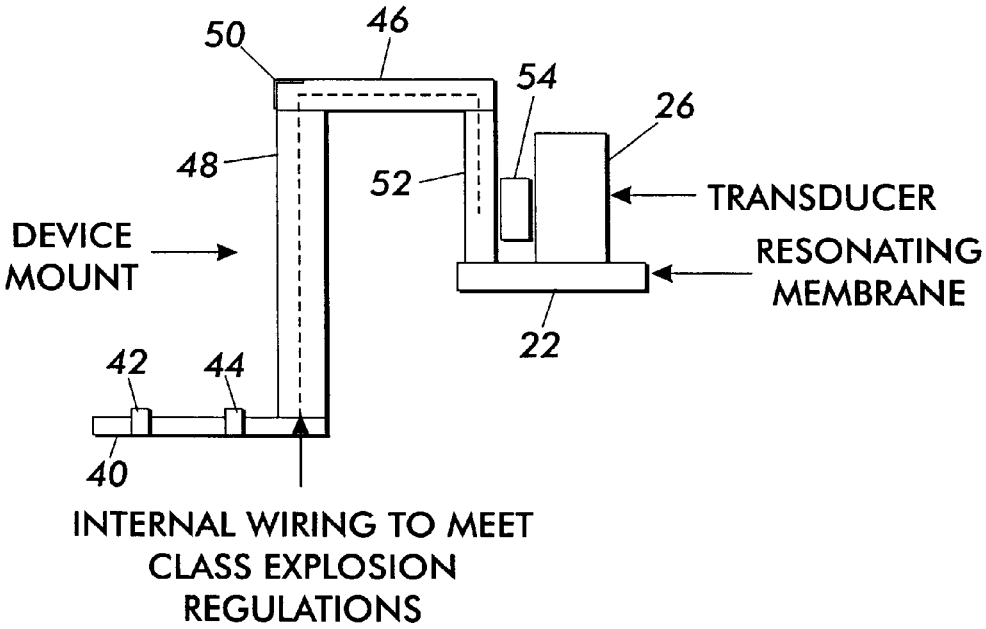
FIGS. 3A and 3B show side and front views of a transducer-membrane mounting mechanism in accordance with one embodiment of the present invention.
Figure 3B:
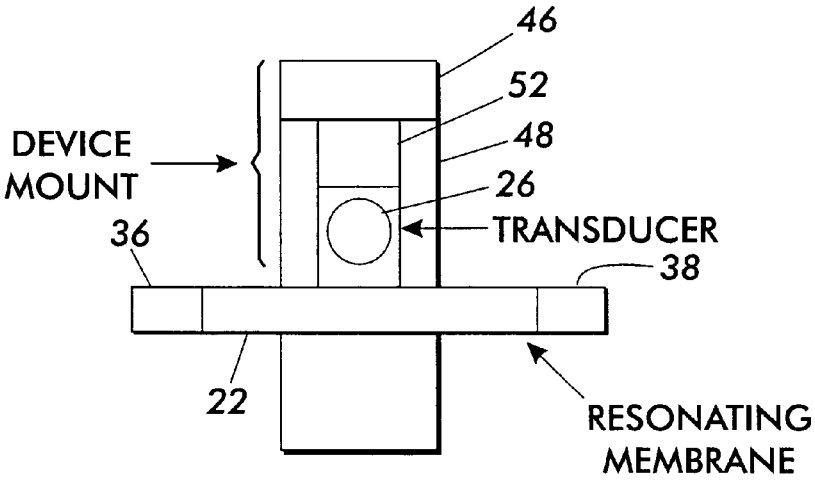

FIGS. 3A and 3B illustrates a mounting arrangement for transducer 26 and membrane 22 where bracket 40 is fixedly coupled to a portion of housing 16 (FIG. 1B) via bolts 42 and 44. An articulated pivot arm 46 rotatably supports the transducer-membrane assembly to a flange 48 depending from the bracket 40 about a pivot point 50. A hinge or other mechanism may provide pivoting. This arrangement enables displacement of the transducer-membrane assembly away from the facing area of screen 12 in order to provide clearance for removal and/or servicing of screen 12 (FIG. 1C). The transducer 26 is secured to a boom 52 depending from pivot arm 46 via stand-off 54 located between boom 52 and transducer 26. In order to meet explosion proof classification standards, internal wiring that powers the transducer 26 runs through a channel that is journalled through flange 48, pivot arm 46, boom 52, and standoff 54 where the wiring attached to the transducer. No part of the electrical wiring is exposed to the environment of the particulate atmosphere in and about the screen 12 during turbo screening operations.

Figure 4:
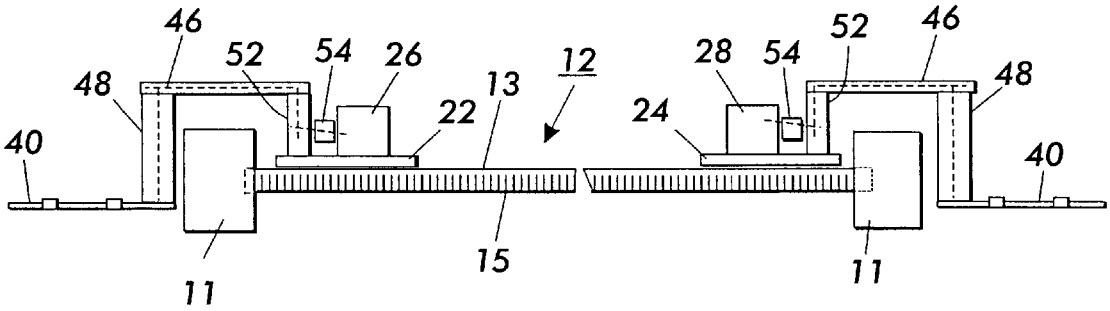
FIG. 4 shows disposition of two transducer-membrane assemblies in relation to a turbo screen.

FIG. 4 illustrates deployment of dual transducer-membrane assemblies, each being constructed according to the arrangement of FIG. 3A. As shown, the transducer-membrane assemblies are mounted on housing 16. In this arrangement, the front side 13 of screen 12 also communicates with intake duct 18 to receive toner particles (in the case where the invention is employed in the electrophotographic imaging arts) or other fine particles in other industrial applications.

Figure 5:
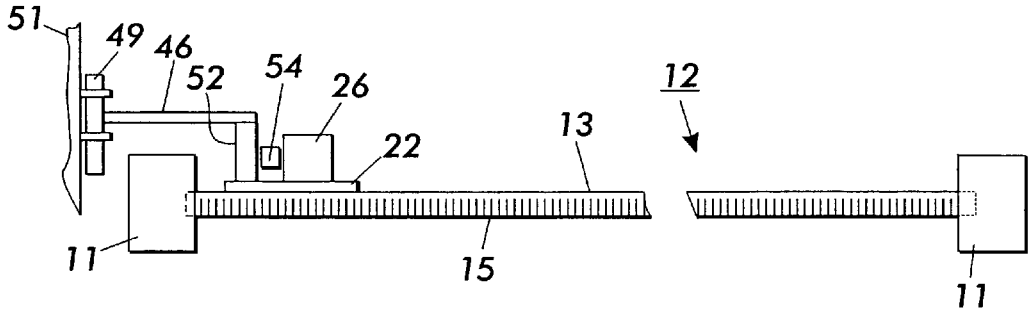
FIG. 5 illustrates an alternative mounting arrangement for a transducer-membrane assembly in accordance with another embodiment of the present invention.

FIG. 5 illustrates deployment of an ultrasonic cleaning and screen de-blinding device according to another feature of the invention. Screen 12 is supported by perimeter ring 11 that lies in the throat of chamber 14 (FIGS. 1A to 1C). The transducer-membrane assembly of FIG. 5 parallels that of FIG. 3A except that pivot arm 46, instead being rotatably attached to a bracket 49, is affixed to the inside wall 51 of housing 16. In the arrangement of FIG. 5, membrane 22 lies in direct contact with the back side 13 of screen 12 to impart cleaning and de-blinding oscillations.

Figure 6:
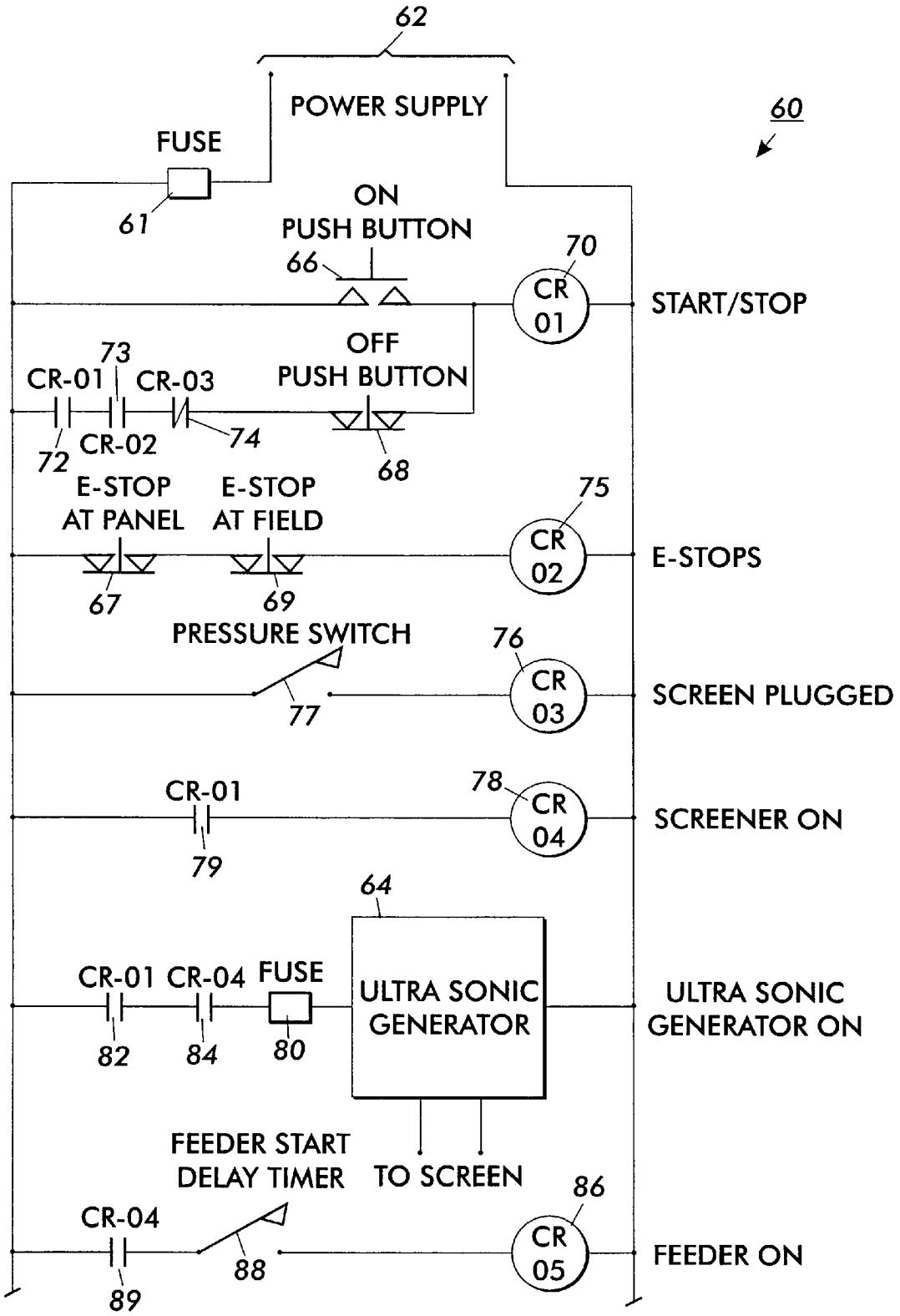
FIG. 6 depicts an electrical circuit for powering one embodiment of a transducer-membrane assembly in an illustrative electrophotographic imaging device.

FIG. 6 shows a power supply circuit 60 that may be deployed in an electrophotographic imaging machine to power an ultrasonic screening and de-blinding device. Circuit 60 receives power from supply lines 62 that feed a number of parallel-connected circuits, including a circuit that drives ultrasonic generator module 64. Fuse 61 provides breaker protection for all sub-circuits in power supply circuit 60. A start-stop circuit 70 includes mutually exclusive "on" and "off" push-button contact switches 66 and 68 that may be engaged by an machine operator to power up or to power down the electrophotographic machine.

Contact switches 72, 73, and 74 respectively respond to start-stop circuit 70, emergency stop circuit 75, and screen plugged circuit 76. The emergency stop circuit includes an interrupt switch 67 preferably located on the operator panel of the electrophotographic machine and a field interrupt switch located within the machine or at a remote location, also being operative to shut down the electrophotographic machine during an emergency. Switch 74 interrupts the start-stop circuit path when a pressure switch 77 of a screen plugged circuit closes in response to build-up of pressure on the front side of screen 12 (FIG. 1B). Pressure build-up indicates particle blinding or clogging of screen 12. Switches 72 and 73 in the start-stop circuit path respectively respond to start-stop circuit 70 and to the emergency stop circuit 75.

Screener "on" circuit 78 activates the turbo screener to effect cyclone action that supplies toner to intake duct 18 (FIG. 1A) and circulates toner particles within chamber 14 (FIG. 1A). Screener "on" circuit 78 includes interrupt switch 79 responsive to the start-stop circuit 78 to activate the turbo screener with start-stop operations.

Ultrasonic generator 64 powers transducers 26 and 28 (FIG. 1C) located at or in direct contact with screen 12 (FIG. 1C). Fuse 80 connected in series with the power supply circuit of ultrasonic generator 64 provides transducer overload protection. Switches 82 and 84 also lie in series with the power supply circuit of ultrasonic generator 64. Switch 82, which responds to stop-start circuit 70, enables the supply of power when the electrophotographic machine is powered up. Switch 84, which responds to screen "on" circuit 78, energizes the ultrasonic generator 64 when the turbo screener is on.

A feeder "on" circuit 86 effects delivery of toner particles from a supply bin (not shown). Delay switch 88 retards delivery of toner particles for a predetermined time period to allow a pressure source or blower of the turbo screener (not shown) to reach a sufficient pressure to adequately effect screening of the particles, and for the machine to reach normal operating conditions. Switch 89, which responds to screen "on" circuit 78, enables the toner feeder to run when the turbo screener is on.

The invention also includes various methods of cleaning and de-blinding in a particulate delivery system, generally. One method comprises circulating or moving particulate material within a chamber 14 (FIG. 1A) to separate the material by size or particle weight, screening the particulate material during circulating within the chamber using a screen or mesh 12 (FIG. 1C) that passes particles of a predetermined size, and inducing ultrasonic waves within the chamber 14 (FIG. 1A) and applying those waves to the screen or mesh 12 during the screening whereby to dislodge particles adhering to the screen or mesh.

The method may be deployed in an electrophotographic imaging process or during screening operations in any industrial application. During screening, a transducer may be used to induce ultrasonic waves to the screen or mesh 12, typically in the range of twenty to fifty kilohertz at a duty cycle between near zero and continuously on, e.g., 100% duty cycle. Inducing ultrasonic waves is achieved by placing a transducer or an interceding wave-coupling member, such as membrane 22 or 24, near or in direct contact with the mesh or screen. When used in electrophotographic imaging, ultrasonic waves maybe turned on in response to a toner feed signal indicative of supplying toner to the chamber of the turbo screener, a turbo screener on signal indicative of a blower supply to the turbo screener, and/or a pressure sensitive switch indicative of clogging of the mesh.

Based on the above illustrations and description, it is apparent that modifications, extensions, and variations of the illustrative embodiments may readily come to those skilled in the art. The invention, for example, is not limited to de-blinding or cleaning of toner particles from a screen used in an electrophotographic machine, but may instead be used in any industrial process and system requiring screening of particulate material. Piezoelectric, magnetorestrictive, or other acoustic sources may be used for the transducers described herein and materials other than metal may be used for the membrane discs if at all used. The mounting may also take on a variety of forms, including integration of the transducer and/or membrane with the screen itself. The juxtaposed transducer assemblies may be disposed horizontally instead of vertical. As such, the invention is defined by the appended claims rather than by the illustrative embodiments.

Accordingly, we claim:

1. In a turbo screening device of an electrophotographic machine that includes a cyclone chamber that separates particulate toner materials by size under cyclone action, an improvement that facilitates cleaning and de-blinding of a screen in the device that filters particulate material comprising:

first and second transducer assemblies, each of the transducer assemblies comprising a transducer, a rigid membrane having inertial projections that are ultrasonically driven by the transducer, and a mounting mechanism that supports the transducer assembly on a frame of said turbo screening device so as to acoustically couple the membrane with the screen.

2. The improvement as recited in claim 1, wherein the mounting mechanism supports the transducer assemblies in direct contact with the screen.

3. The improvement as recited in claim 1, wherein the mounting mechanism supports the transducer assemblies to provide the acoustic coupling by integrating the membrane directly with the screen.

4. The improvement as recited in claim 1, wherein the mounting mechanism includes an internal channel that routes electrical wiring that powers the transducer along a path protected from an environment of particulate material within the cyclone chamber.

5. The improvement as recited in claim 1, wherein the mounting mechanism rotatably attaches to the frame whereby to provide removal clearance for said screen by pivoting said transducer assembly away from the screen.

6. The improvement as recited in claim 1, wherein said membrane comprises a symmetric piece of metal having a pair of inertial projections and a predetermined resonant frequency, and the transducer attaches to a center point thereof to effect radiation of ultrasonic waves outward from the center point.

7. The improvement as recited in claim 1, wherein each transducer is positioned on a back side of the screen.

8. The improvement as recited in claim 1, wherein the transducer assemblies are vertically aligned on a vertically disposed screen.

9. The improvement as recited in claim 1, wherein the transducer is driven at a predetermined frequency and at a duty cycle between zero and 100%.

10. The improvement as recited in claim 9, wherein the predetermined frequency is about 36 kilohertz and the duty cycle is 100%.

11. The improvement as recited in claim 9, wherein the transducer is driven in accordance with at least one of a toner feed signal indicative of supplying toner to a chamber of the turbo screening device, a turbo screener on signal indicative of a blower supply to the turbo screening device, and a pressure sensitive switch indicative of clogging of the screen.

12. A toner delivery system that includes ultrasonic cleaning comprising:

a housing, a chamber within said housing that effects separation of toner particles by size by circulating or moving said particles within said chamber, a screen located within the chamber that passes toner particles less than a predetermined size, and at least two transducers coupled to said housing that drive respective membranes having inertial projections that deliver ultrasonic waves to said screen during screening operations whereby to dislodge particulate material adhering to the screen.

13. The toner delivery system as recited in claim 12, wherein the transducer acoustically couples the screen by direct contact therewith.

14. The toner delivery system as recited in claim 12, wherein the chamber comprising a vertically disposed cyclone chamber, and wherein each of the transducers are vertically aligned with respect to each other and acoustically coupled with the screen.

15. The toner delivery system as recited in claim 12, wherein each transducer comprises a half-moon shaped metallic material that includes said inertial projections suitable of transferring ultrasonic waves from the transducers to the screen.

16. The toner delivery system as recited in claim 12, further including a mounting mechanism that positions said at least two transducers about a surface of the screen and said mounting mechanism includes an embedded channel for carrying electrical wiring for the transducers whereby to shield the wiring from a potentially explosive environment of toner particles.

17. The toner delivery system as recited in claim 12, wherein the transducer is driven at a predetermined frequency having a relation with a natural harmonic frequency of said membrane.

18. The toner delivery system as recited in claim 17, wherein the predetermined frequency is between 20 and 50 kilohertz.

19. The toner delivery system as recited in claim 17, wherein the transducer is driven in accordance with at least one of a toner feed signal indicative of supplying toner to the chamber, a screener on signal indicative of a blower supply, and a pressure sensitive switch indicative of clogging of the screen.

20. A particulate delivery system that includes ultrasonic cleaning for a screen located therein, the system comprising:

a housing, a chamber within the housing that separates particles by circulating or moving the particles within said chamber, a screen located within the chamber that passes particles less than a predetermined size, and at least one transducer coupled to said housing, said at least one transducer driving a respective membrane having inertial projections that deliver acoustic energy to said screen during screening operations whereby to dislodge particles adhering to the screen.

21. In a particulate material delivery system, a method comprising:

circulating the particle material within a chamber to separate the particulate material by at least one of size and weight, screening the particulate material during circulating within the chamber using a mesh that passes particles of a predetermined size, and inducing ultrasonic waves within the chamber via a membrane that includes inertial projections and applying said waves to the mesh during the screening step whereby to dislodge particles adhering to the mesh.

22. The method as recited in claim 21, wherein said particulate material comprises chemical toners used in an electrophotographic imaging machine.

23. The method as recited in claim 22, further comprising inducing the ultrasonic waves according to at least one of a toner feed signal indicative of supplying toner to the chamber of a turbo screener, a turbo screener on signal indicative of a blower supply to the turbo screener, and a pressure sensitive switch indicative of clogging of the mesh.

24. The method as recited in claim 21, wherein said particulate material includes chemical additives.

25. The method as recited in clam 21, further comprising inducing ultrasonic waves by exciting a transducer in the frequency range of 20 to 50 kilohertz.

26. The method as recited in claim 21, wherein said inducing step includes placing a transducer in direct contact with the mesh during the screening step.

* * * * *